United States Patent [19]

Schall

[11] Patent Number: 5,040,796

[45] Date of Patent: Aug. 20, 1991

[54] PLAYING CARD-BASED SIMULATED FOOTBALL GAME

[76] Inventor: John T. Schall, 3391 Ohio St., San Diego, Calif. 92104

[21] Appl. No.: 591,368

[22] Filed: Oct. 1, 1990

[51] Int. Cl.[5] ..... A63F 7/06; A63F 1/04

[52] U.S. Cl. ..... 273/94; 273/247; 273/85 G; 273/138 A; 116/225

[58] Field of Search ..... 273/1 E, 93 C, 94, 85 G, 273/244, 247, 277, 88, 138 A, 86 B; 116/222, 225

[56] References Cited

U.S. PATENT DOCUMENTS

| | | | |
|---|---|---|---|
| 1,552,630 | 9/1925 | Michaelian | 273/94 R |
| 1,577,932 | 3/1926 | Palese | 273/94 R |
| 1,614,881 | 1/1927 | Conley | 273/94 R |
| 2,044,506 | 6/1936 | Lundquist | 273/94 R |
| 2,743,105 | 4/1956 | Westbrook | 273/94 R |
| 2,873,971 | 2/1959 | Siegel | 273/94 R |
| 3,231,276 | 1/1966 | Cooper | 273/94 R |
| 3,556,525 | 1/1971 | Pegg | 273/94 R |
| 3,724,852 | 4/1973 | Payne | 273/94 R |
| 3,729,130 | 4/1973 | Bortz | 273/94 R X |
| 3,853,264 | 12/1974 | Hovorka | 273/247 X |
| 3,947,039 | 3/1976 | Sadler et al. | 273/247 |
| 3,995,863 | 12/1976 | Cummins | 273/247 |
| 4,009,679 | 3/1977 | Kircher | 273/94 R X |
| 4,082,278 | 4/1978 | Bolton | 273/94 R |
| 4,202,546 | 5/1980 | Bromberg | 273/94 R X |

*Primary Examiner*—Edward M. Coven
*Assistant Examiner*—Sebastiano Passaniti
*Attorney, Agent, or Firm*—John J. Murphey

[57] ABSTRACT

A playing card-based simulated football game comprising a plurality of playing cards for at least two players, each of whom represents opposing football teams, the playing cards containing integers and play-controlling indicia for producing, under certain playing conditions, simulated football game plays including "draws", "traps", "bombs", "sacks", "dogs", and "live ball" situations; a plurality of drawing cards housed in a container and retrieved by a player upon notification of the occurrence of a foul, the drawing cards showing the identity of the offending team, the type of foul which occurred and the penalty therefor, all virtually indistinguishable from those actually encountered in the game; a try-kick and field goal chart device comprising a hand-held container and a strip of flat material slidingly received therein, having integers printed thereon, for matching with apertures in the cover to indicate the values of playing cards that may be used to possible insure success of the kick; an elongated strip having a series of apertures formed therein and uniformly spaced therealong to simulate both the American football field of 100 yards asnd the Canadian football field of 110 yards, and further including a plurality of small pegs for insertion in the apertures to mark the start of a drive, the line of scrimmage, and the line-to-gain; and an electronic foul indicator, including a simulated official's whistle, for notifying the players of the simulated occurence of a foul, the occurrences arranged in random patterns simulating the frequency of such fouls in a football game, and the electronic foul indicator controlled by the players during playing of the game.

19 Claims, 5 Drawing Sheets

PLAYING CARD-BASED SIMULATED FOOTBALL GAME

BACKGROUND OF THE INVENTION

1. Field of the Invention

This invention pertains to the field of recreational and amusement games. More particularly, it pertains to a playing cardbased game for two or more persons that simulates, to a high degree of reality, the esoteric aspects of the game of football.

2. Description Of The Prior Art

Card games have existed as far back as the ancient Chinese cultures. There is something both mysterious and exciting about holding a multiplicity of pasteboards, hoping to overpower the opponent with this hand or the next, while relying on skill and the probabilities inherent in all games of chance. Even those whose game-playing skills are not fully developed still seek to play.

Some card games have their own reward such as the poker game pot or the bridge grand slam. Other card games, either by themselves or played along with special boards and dice, etc., engage in mock combat normally held in other arenas such as war, football games, baseball games, real estate transactions and stock transactions. It is to this type of board game, namely the engagement in mock football games, that this invention is directed.

Football games have been simulated with cards for many years. More recently, the game has been simulated by the use of board games containing electronically actuated vibrating means to provide movement of football player figures fixed on the board to progress up and down a simulated playing field. More recently, computer components have been assembled to simulate movement of football players over a simulated field. Scoring is based upon a combination of random selection of numbers or directions coupled with the skill of the player in pressing buttons or actuating switches with sufficient dexterity to overcome a general resistance built into the electronic circuitry. In all of these attempts, however, none has fully simulated control of individual teams using the plays typical to the football game such as running, passing, and kicking, and achieving any realistic degree of simulation with actual conditions encountered in football games. As a result, these simulated games lose their appeal after a period of time, either by virtue of the players adapting to the skill requirements of the switches or other mechanical features needed to be manipulated during the game, or becoming disinterested because of the loss of control of the outcome of the game due to the total random selection of the game elements.

Those who have once played football still seek the thrill of formulating offensive and defensive football plays in an environment closely simulating the actual football game itself and utilizing their mental skills to overpower the opponent now that their physical skills are no longer sufficient to allow them to personally engage in an actual football game. Accordingly, there is a significant need for a playing card-based simulated football game which allows the players to utilize their mental skills in planning and executing the various offensive and defensive plays in an environment that closely simulates the actual game itself.

SUMMARY OF THE INVENTION

The instant invention is a playing card-based football game that closely simulates the circumstances encountered in actual football games and, except for the physical skills normally required in playing football, permits the players as "teams" to engage in virtually all facets of the game. The players may now engage in a wide variety of plays, including running, passing, kickoffs, kickoff returns, punts, punt returns, try-kicks, and field goal attempts. Other offensive plays involving draws, traps, bombs, completions and blocking are also featured, as well as defensive maneuvers such as incompletions, interceptions, sacks and other tackling.

In addition to the offensive and defensive plays, special electronically-based foul indicator means is provided to notify the players of the occurrence of a foul, said occurrences arranged in random patterns simulating, however, the frequency of occurrence of such fouls in both college-based and professional-based football games. The indicator means is controlled in large part by the players and divided into "live ball" and "dead ball" fouls as the same is experienced in actual football games. To further simulate football conditions, the electronic foul indicator means notifies the players of a foul by the use of an electronic generated audible tone which is virtually indistinguishable from the whistle commonly heard in actual football games.

A plurality of drawing cards is utilized in this invention that indicate the offending team a specific foul, and the penalty therefor, and these yards are arranged to occur before or during certain types of plays such that the foul would normally be encountered in actual football playing. Even further, "dead ball" fouls, such as encroachment and delay of game, are usable herein and lend realism to the game.

To make the game even more lifelike, a strip of solid material is divided into simulated 1-yard divisions, thereafter indexed in 5-Yard groups and labeled in 10-yard increments to simulate an actual football field in length and indicia. Pegs are provided, for use by the players, to be inserted in the respective apertures formed along the strip to locate the start of a drive, the line of scrimmage and the line-to-gain. Even further, means are provided to transfer the strip of simulated 100-yard length for the American football field into a 110-yard strip to simulate the Canadian football field, thereby providing for a broader range of participation with both American and Canadian football league rules.

A try-kick and field goal chart device is provided that realistically estimates actual possibilities of success of a try kick or a field goal attempt, depending upon the distance of the scrimmage line from the goal. All of these aspects of the instant invention provide a thoroughly enjoyable, highly specialized, but easily utilized game that simulates the actual playing of college and professional football to such a high degree that it is virtually indistinguishable in features and potential score from that encountered in actual football situations.

Accordingly, the main object of this invention is a playing card-based simulated football game that approaches with a high degree of fidelity, the actual conditions of play encountered in real football games. Further objects include a game that utilizes actual football playing strategy in conjunction with the randomness engendered in a playing card-based system and eliminates, to a large extent, the random use of game features heretofore found untrustworthy and unappealing in the prior art. Other objects of the invention include a game that utilizes the types of offensive and defensive maneuvers normally encountered in a football game in conjuction with a random accessed-based foul indicator, providing for "live ball" and "dead ball" fouls, and that simulates, to a high degree, the frequency of occurrences of such fouls normally encountered in a football game. Still other objects of the invention include series "dead-ball" and "live-ball" foul indicating draw cards, housed in a specific container, to be utilized in conjunction with the electronically-based random accessed foul indicator, to provide for meaningful occurrences of realistic fouls throughout the playing of the game to further simulate the actual conditions encountered in a football game. Even still further objects include a simulated football field strip containing features utilized in both American football and Canadian football to provide or different lengths of fields in playing these games.

These and other objects of the invention will become more apparent when reading the description of the preferred embodiment taken together with the drawings appended hereto. The scope of protection sought by the inventor may be gleaned from a fair reading of the claims that conclude this specification.

DESCRIPTION OF THE PREFERRED EMBODIMENT

Figure 1:
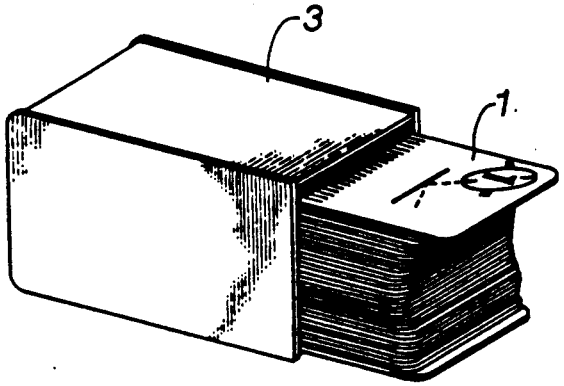
FIG. 1 is an illustrative view of the plurality of playing cards, housed in a container, that are instrumental in playing the game of this invention.
Figure 2A:
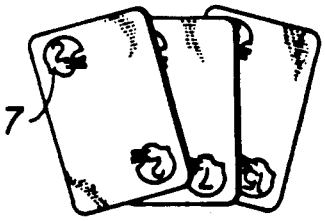
FIGS. 2*a, b, c, d* and *e* are illustrative view of the various types of playing cards that are housed in the container shown in FIG. 1 and used in this game.
Figure 2B:
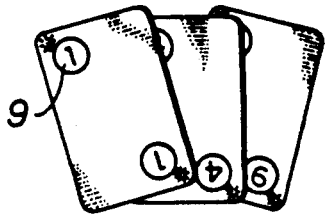
Figure 2C:
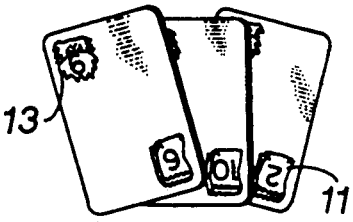
Figure 2D:
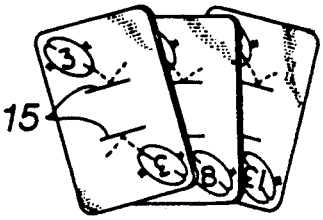
Figure 2E:
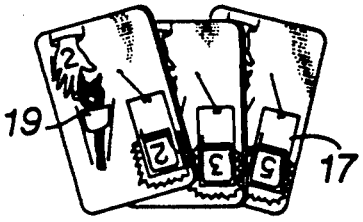

As shown in the figures, where like elements are identified with like numerals throughout the nine figures, FIG. 1 shows a plurality 1 of playing cards temporarily housed in a container 3, said cards utilized by two players, each of whom represents an opposing football team. Container 3 is utilized when the game is not played, e.g., to store the cards or to transport the cards from place to place. Preferably, there are 150 cards, not including omnibus-type replacement cards and cards indicating time remaining to play in a half or the game.

FIGS. 2*a* through 2*e* show the cards separated into a plurality of groups, each group illustrating the use and effect of cards in plays during the football game. Preferably, cards 1 contain integers that range from 1 through 15 that are placed in two opposite corners on one side only of the cards. These integers, and the arithmetic difference in integers of cards played, are used in computing the gain or loss in offensive plays, the completion, incompletion or interception of a pass, the blocking or deflection of a try-kick or field goal kick and in other features of the football game. The relative number of cards in each card group has been carefully adjusted to produce, over a real time span where the cards are shuffled and dealt in random order, the frequency of occurrence of plays of the particular type actually encountered in real football games.

Card group 2*a* preferably contains 50 cards and each bears, with integers ranging from 1 through 15, the design of a helmet 7 in both corners which, when one of these cards is used on a play, usually produces routine results in any play of the game.

Card group 2*b* preferably contains 45 cards and each bears, with integers ranging from 1 to 15, the design of a bomb 9, in both corners which, when one of these cards is used on an attempted pass, allows the offense to obtain extra yardage on a completion and the defense to obtain extra yardage on an interception.

Card group 2*c* preferably contains 30 cards and each bears, with integers ranging from 1 through 15, the design of a sack 11 in one corner and the design of a face of a dog with part of a football uniform in its mouth 13 in the opposite corner which, when one of these cards is used on a play, allows a defensive player to break through the scrimmage line into the offensive backfield and cause the offense to lose yardage by, respectively, his "sacking" the quarterback or his "dog" tackling a ball carrier behind the line of scrimmage.

Card group 2*d* preferably contains 15 cards and each bears, with its integers ranging from 1 to 15, the design of a football bouncing on the surface of the football field 15 in both corners which, when one of these cards is used during recovery of a fumble, muff or blocked kick allows the recovering team to advance the ball.

Card group 2*e* preferably contains 10 cards and each bears, with integers ranging from 2 through 5, the design of a mouse trap 17 in one corner and the design of a gun drawn from a holster 19 in the opposite corner which, if on the defensive line, allows the offense to gain extra yardage on a running play by, respectively, a "trap" or "draw" play.

Figure 3:
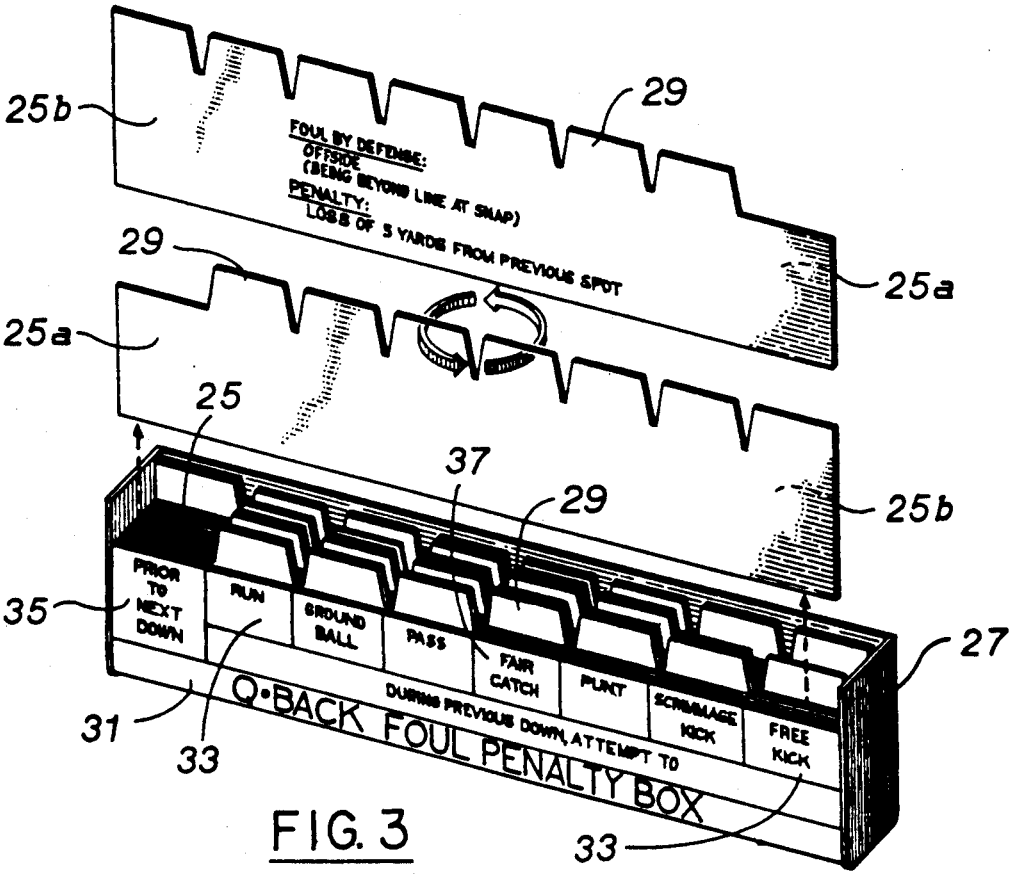
FIG. 3 is an illustrative view of the plurality of drawing cards, housed in a container, with one of the cards removed from above the container and reversed to show how the identity of the offending team, foul and penalty are arranged on the card.

As shown in FIG. 3, a plurality of elongated drawing cards 25 is provided and housed in a container 27 and these cards are retrievable by pulling up on tabs 29 that are spaced in controlled order, albeit not sequentially, along the top edge thereof. As shown, the front wall 31 of container 27 has listed thereon a series of indices 33 indicating, except for the far left-hand indicia 35, the different types of offensive plays that can be attempted, for example in a "fair catch" 37 of a kick. If a foul occurs during one of these plays, it is known as a "live ball" foul. As will be more clearly explained hereinafter, indicia 35 indicates a foul that could occur immediately prior to the commencement of a down. This foul is known as a "dead ball" foul.

The inventor has established the types of fouls generally encountered in football games and the penalties therefor and has classified these fouls according to the type of plays prior to or during which they are called. Specifically, "dead ball" fouls include "delay of game", "false start", and "encroachment". As will be further explained, these fouls may be called only immediately before commencement of a play to truly stimulate actual fouls that occur under these circumstances. Likewise, the other fouls are classified according to whether during the previous down, the offense attempted to run, ground the ball, pass, fair catch, punt, etc., and tabs 29 are placed opposite these particular indices to truly represent the actual fouls that would normally be called thereon. As is shown on card 25*a*, that is depicted raised above container 27, a foul may have more than one tab 29 associated therewith, indicating that such a foul could occur during more than one type of football play. The drawing card pulled from container 27 shows surface 25*a* to be totally blank to mask the penalty from the players. As shown in FIG. 3, the extracted tab may be turned over, as shown by the arrows, to disclose drawing card surface 25*b*. Listed thereon is the identity of the offending team, the indicated foul and the penalty therefor. Again, the fouls and the penalties therefor have been drawn from the actual rules of professional and college football to near-exactly simulate the normal types and penalties of fouls called in a football game.

Figure 4:
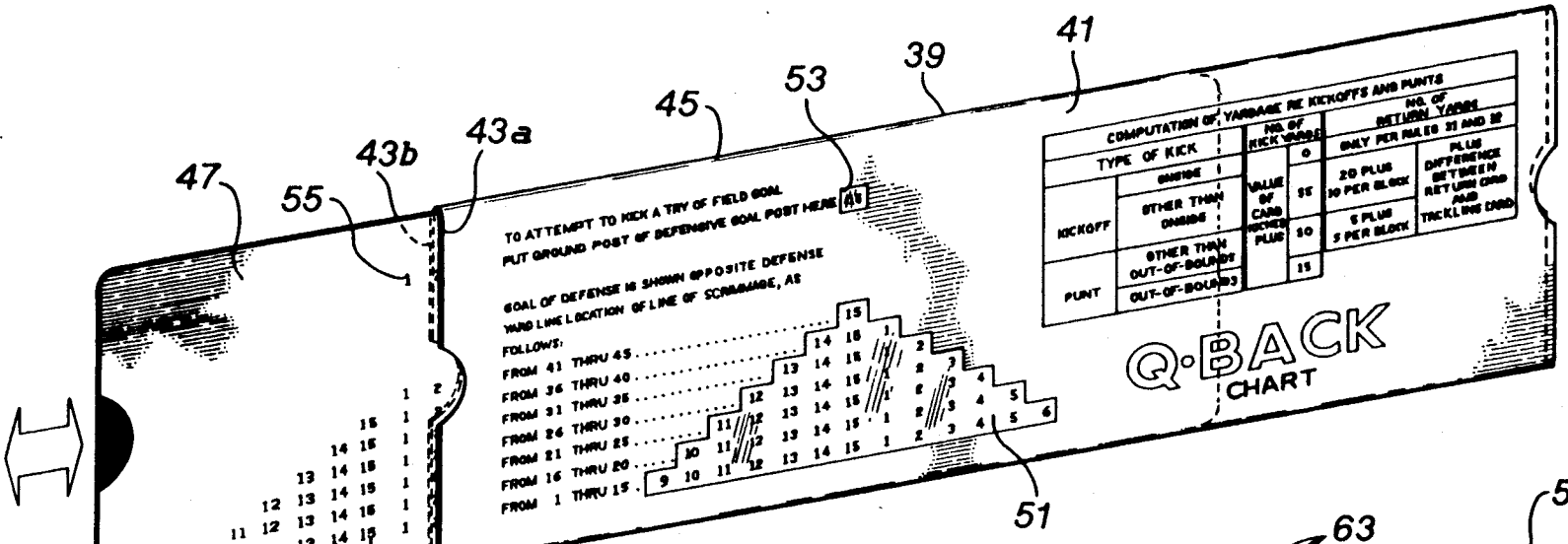
FIG. 4 is a top plan view of the try-kick and field goal chart device utilized in this invention to determine the values of playing cards that may be used to obtain possible success of the kick.

When a team contemplates attempting a try-kick or a field goal, the player utilizes a unique device 39 shown in FIG. 4. Device 39 comprises a hand-held flat envelope-type container 41 having front and back container surfaces 43*a* and 43*b* held together in adjacent arrangement along top and bottom edges 45. A flat, substantially wide strip 47 of sheet material, such as cardboard, is slidingly received between surfaces 43*a* and 43*b*, and contains a series of integers 49, ranging from 1 through 15, placed in a triangular shape for appearance through a window 51 formed in front container surface 43*a* below a spaced-apart aperture 53 also formed in front container surface 43*a*. A series of integers 55 is placed on strip 47 and arranged to appear, one by one, under aperture 53 when strip 47 is moved transversely inside container 41. To determine the potential success of an attempted try-kick or field goal, the integer appearing under aperture 53 indicates the ground post of the defensive goal post. It should be noted that the goal is the vertical plane determined by a horizontal crossbar and a pair of spaced-apart vertical pipes or staffs (not shown here). As one would expect, the closer the line of scrimmage (and hence the kicker) is to the goal, the greater the chances are that the kick will be successful by the ball passing through the goal. Window 51 on front container surface 43*a* shows an increasing number of spaces in a lateral alignment that relates the potential for success of the kick as a function of position of the line of scrimmage, with the broadest range or greatest chance of success being the broadest part of the window at the lower portion of window 51, with a decreasing chance of success as the scrimmage line is more distant from the goal, to a point at the top of window 51 where only one integer may be shown when the line of scrimmage is farthest from the goal. This is entirely consonant with the actual possibility of success in attempting a try-kick or a field goal as the kicker is removed from the goal.

Figure 5:
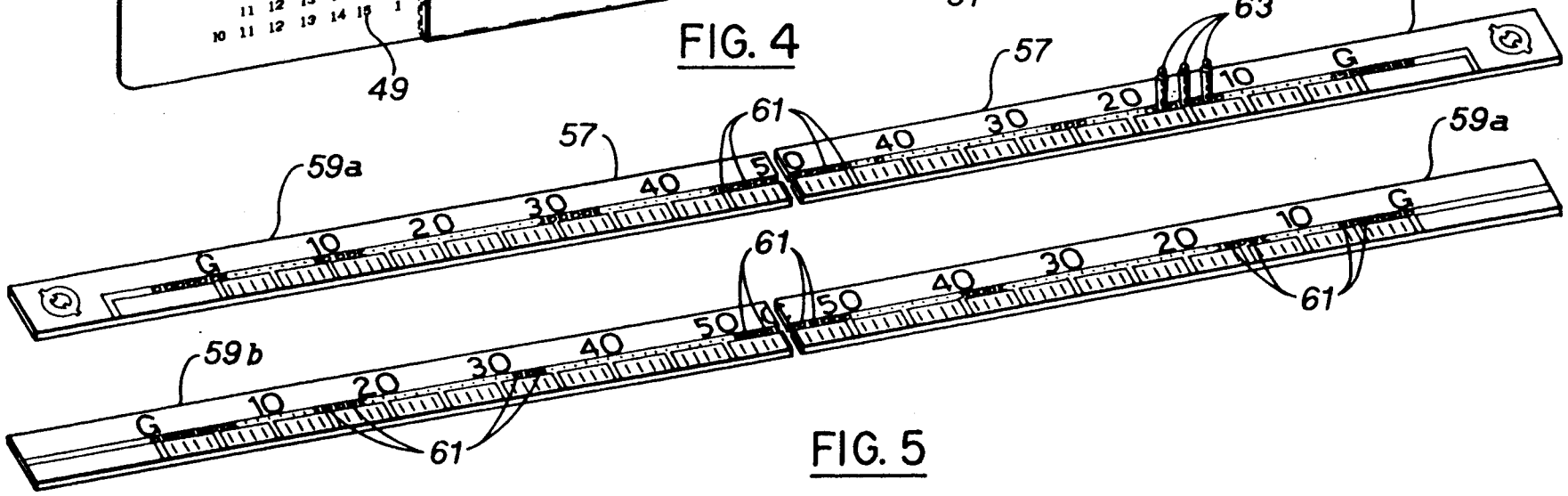
FIG. 5 is a front and rear view, respectively, of the elongated strip containing a series of apertures and broken into two smaller segments used to mark the location of play on the simulated football field.

Shown in FIG. 5 is an elongated strip 57, divided into two shorter strip segments 59*a* and 59*b* having a series of apertures 61 formed therein, preferably midway between the elongated sides of said strip segments and uniformly spaced there along to indicate the linear yards along the simulated playing field from the goal line on each end marked with a "G" as shown. It is preferred that strip segments 59*a* and 59*b* are of equal length. At their joinder in end-to-end fashion, the halfway point or 50-yard line for the American football game is shown by integer "50" having the integer "5" on one end of strip 59*a*, and the "0" on the other end of strip 59*b*, indicating the midpoint of the American football field. As shown on the reverse side of strips 59*a* and 59*b*, a different set of indicia numbers are printed, showing a goal-to-goal length of 110 yards, as in Canadian football, with the two 50-yard markers being separated at the midpoint of the field by a 10-yard stretch, common in the Canadian football playing rules, and indicated by a split letter "C" as shown.

A plurality of, preferably three, small pegs 63 are shown used with strip 57 and are made of a size sufficient to allow each peg to be inserted at one end into apertures 61, for the purpose of indicating the start of a drive, the line of scrimmage and line-to-gain that are common in the football game.

Figure 6:
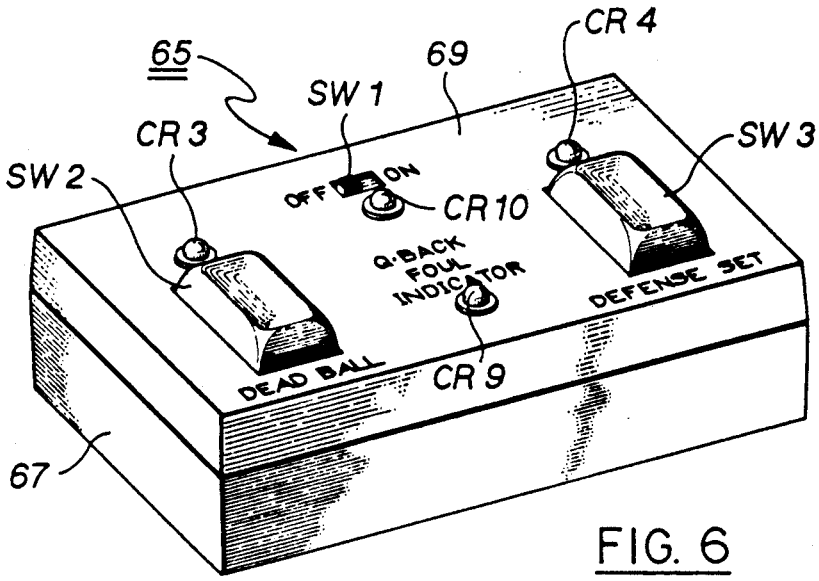
FIG. 6 is an illustrative view of the exterior of the electronic foul indicator means showing the location of switches and lights used therein.

As shown in FIG. 6, electronic foul indicator means 65 is provided for indicating both "dead ball" fouls and "live ball" fouls during the game. Before describing the intricacies of means 65, a short explanation of the nature of fouls is needed. A "live ball" foul is one called during a play that results in possible assessment of the penalty therefor upon completion of the play. To those who follow football, "live ball" fouls include offside, clipping, holding, roughing the passer, pass interference, etc. A "dead ball" foul is one called immediately before commencement of a play such as "encroachment".

The inventor has conducted extensive research into the game of football and has determined that "live ball" fouls occur at the rate of approximately twice as often as "dead ball" fouls. In addition, the statistical average of each type of foul called, either "dead ball" or "live ball", is made to appear in the number of tabs 29 extending from each drawing card 25, with the more tabs per card indicating the greater the probability of this foul being called.

As his own lexicographer, the inventor will now establish some terms to be used in the balance of this specification. When reference is made to "high" logic levels, such levels mean direct current (DC) voltage from about 4.5 volts up to about 9 volts, the battery voltage used in powering the electronic circuit of foul indicator means 65. When reference is made to "low" logic levels, such levels mean DC voltage that is below 4.5 volts and preferably about zero volts or ground. This is common in the art.

Figure 8:
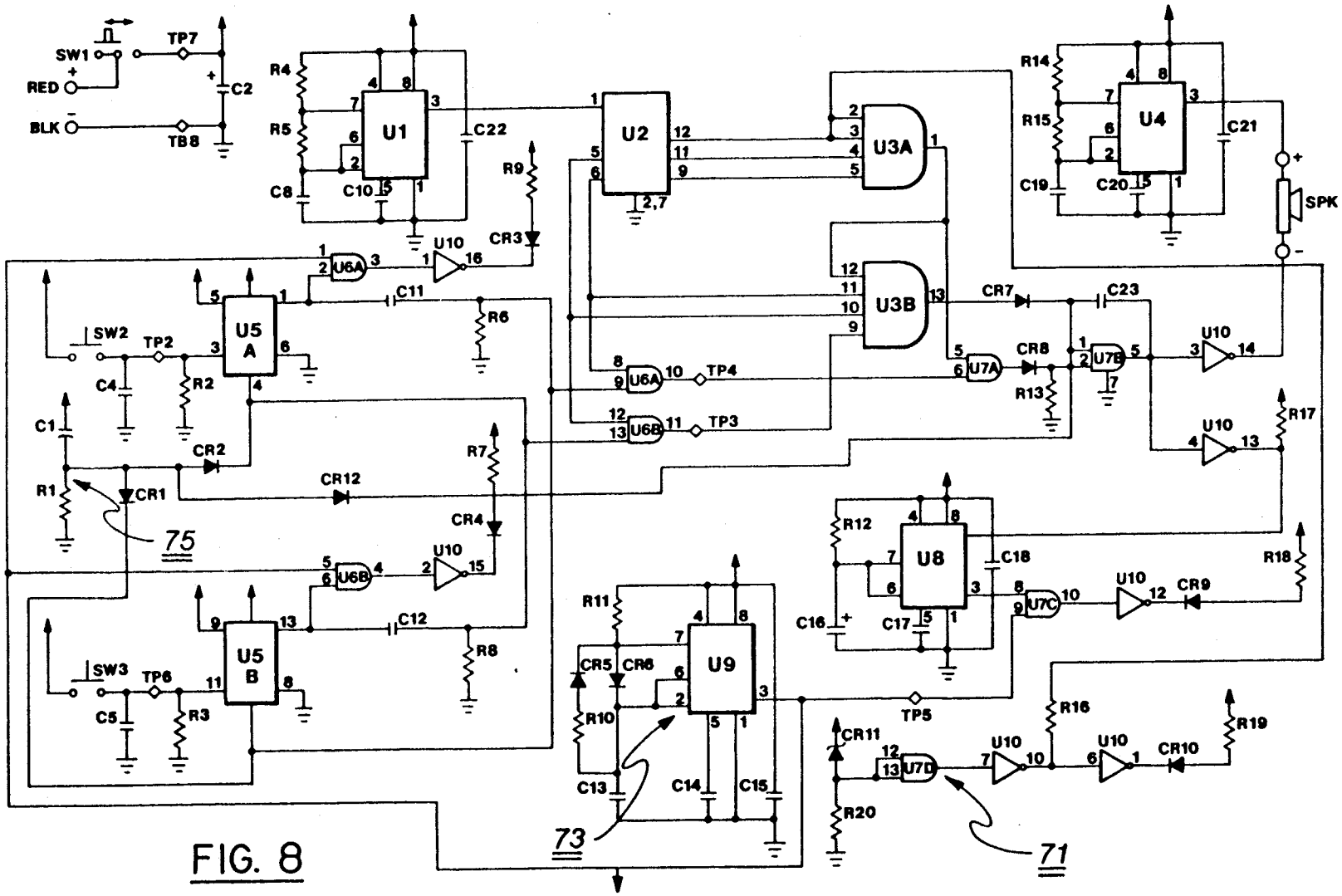
FIG. 8 is a schematic drawing of the electronic circuitry housed within the electronic foul indicator means shown in FIG. 6; and, FIG. 9 is an illustrative view of the wave forms at different points in the circuit as shown in FIG. 8.

Referring now to FIG. 8, the circuit of this invention is conveniently contained on a circuit board (not shown) on which are mounted a series of components, including integrated circuits, transistors, diodes, resistors, and capacitors. The solid lines between components refer to conductors and will not be individually numbered except where necessary. Where conductors cross and the intersection is marked with a dot or period, there is a junction between them; where one conductor crosses another and the intersection has no dot, there is no junction. The small number next to the conductor as it attaches to a component, is the pin number of the component. These are common in the art.

To insert the dual rate of occurrences of foul calling in the game, certain unique characteristics are included in means 65. As seen in FIG. 6, means 65 includes a container or box 67 on top of which is a face plate 69. On plate 69 is mounted on "off-on" switch SW1 to provide battery power, preferably a nine-volt battery, (not shown); a "dead ball" foul switch SW2 and accompanying indicator LED lamp CR3; a separate "dead ball " foul set switch SW3 and accompanying indicator LED lamp CR4; and a "low-voltage" LED indicator lamp CR10 that indicates when the battery is drained and/or in need of replacement.

As shown in FIG. 8, a series of precision timers, AND gates, and flip-flops are interconnected with various other electronic components to produce the foul indication at the proper frequency of occurrence during the game. Battery power is provided through off-on switch SW1 to a precision timer U1 that outputs a basic train "F" of eight pulses-per-second at pin 3. Resistors R4 and R5 and capacitor C8 in combination control the pulse train of U1. U1 is preferably an LM555 dual precision timer; the sources and typical values of the components shown in FIG. 8 are listed in a table that is included in this specification. U1 pin 3 inputs the pulse train F to U2, a 7-stage binary counter, that divides the pulses and outputs them from pin 12 at four pulses-per-second (F/2); from pin 11 at two pulses-per-second (F/4); from pin 9 at one pulse-per-second (F/8); from pin 6 at one pulse, every other second (F/16); and, from pin 5 at one pulse every four seconds (F/32). The pulse trains from U2 pins 9, 11 and 12 output to U3A, a 4-input AND gate. U2 pin 12 inputs to U3A pins 2 and 3 while U2 pins 11 and 9 input to U3A pins 4 and 5 respectively. If all inputs to U3A are high at the same time, then output from U3A pin 1 will be high, otherwise the output will be low. U3A pin 1 output will be high only one time out of 16 basic pulses, thus the pulse train at U1 pin 3 is the controlling pulse. U2 output at pin 5 will be high only one time in 32 pulses, then stays high for 32 pulses, then goes low for 32 pulses, etc. U2 pin 6 output goes high in 16 pulses, stays high for 16 pulses, then goes low for 16 pulses, and so on.

Figure 9:
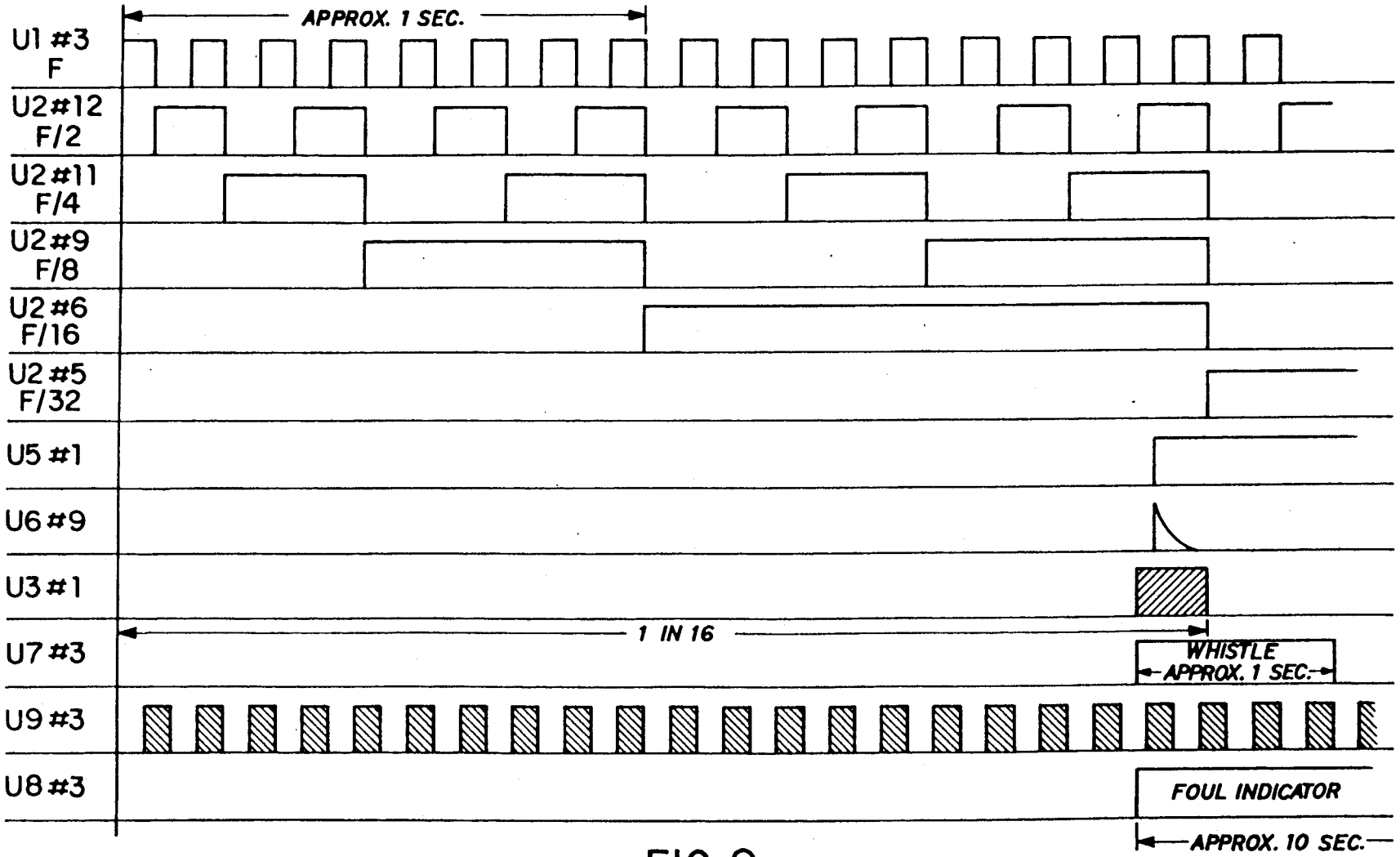

Switch SW2 is normally open, single-pulse switch that operates as the "dead ball" switch while SW3 is the same type switch and operates as the "defense set" switch. Depression of either switch creates a tooth-shaped pulse (see FIG. 9 U6#9) that latches either flip-flop U5A or U5B and inputs to a 2-input AND gate U6A at pin 9 or 2-input AND gate U6B at pin 13. The latching of flip-flops U5A and U5B prevent multiple depressions of SW1 or SW2 from adding more pulses to the circuit while allowing alternating depressions between the switches to input the AND gates U6A and U6B. Resistor R6 and capacitor C11, as well as resistor R8 and capacitor C12, operate in combination to create the tooth-shape pulse shown in FIG. 9 as U6#9.

AND gates U6A and U6B are shown connected through their respective U5 flip-fops to switches SW2 and SW3 and are provided to cause LED indicator lights, CR3 and CR4, to light to show which of the switches has been last depressed. An invertor, shown at connected downstream from each AND gate U6 to allow a pulse U10, is current to light LED indicators CR3 and CR4 so as to save battery power as will be explained later.

Another precision timer U4 is shown connected to resistors R14 and R15 and capacitor C19 to combine with the built-in frequency generator of a speaker SPK to achieve an audible penalty indication duplicating the sound of a typical official's whistle. At the same time, another precision timer U8 is connected to resistor R12 and capacitor C16 to provide power to illuminate LED foul indicator CR9 for a period of time, preferably about 10 seconds. This is so that foul "whistles" from games played nearby will not inadvertently be assumed to be the penalty in another game and the light will come on when the whistle sounds and remain on for 10 seconds to provide a visual indication that one particular whistle has been sounded.

A "dead ball" foul can be indicated after the offense and defense are set, i.e., immediately upon the defense depressing the "defense set" switch at SW3. Further, a foul during a play can be indicated when the play is completed, i.e., when the "dead ball" switch SW2 is depressed; this is a "live ball" foul. A foul will only be indicated when the tooth-shaped pulse generated by depressing either switch SW2 or switch SW3, is generated at the leading or trailing edge of a pulse outputted from U1 pin 3, U2 pins 12, 11, 9, 6, or 5 and U5A pin 1. When this occurs, two things happen: speaker SPK is energized to emit a sound for one second (determined by the combination of values of resistor R13 and capacitor C23 at AND gate U7B) and LED indicator light CR9 is activated for 10 seconds as described earlier.

Means 71 is provided to initiate a warning when the battery is running low. Means 71 comprises a Zener diode CR11 that is connected to a 2-input AND gate U7 and the output inverted at invertor U10, joined with the input pulse of input pins 2 and 3 of AND gate U3, to energize LED indicator lamp CR1O, to slowly blink when the voltage in the battery drops below a chosen value such as 3.9 volts. The slow pulse of U3 input pins aids in drawing the players' attention to this indicated condition of low voltage.

Means 73 is also provided to reduce the electrical load on the battery during play. A separate precision timer U9 is connected to resistors R10, R11, and to diodes CR5 and CR6 to provide a rapid pulse output and act as a pulse generator. This high frequency pulse rate is inputted to AND gate U6A at pin 1 (for flip-flop U5A) and U6B at pin 5 (for flip-flop U5B). When either LED indicator lights CR3 or CR4 are lit, such as during play, the high pulse rate from pulse generator allows the respective LED to be lit but reduces the current draw on the battery.

As previously mentioned, the statistical analysis of football games has led to a determination that "live ball" fouls occur at approximately twice the rate of "dead ball" fouls. This difference is determined in this invention by the output of U2 pins 5 and 6. U6A pin 10 will be nigh if the respective inputs 8 and 9 are simultaneously high. Likewise, U6B pin 11 will only be high if the respective inputs at pins 12 and 13 are simultaneously high. U6A output is inputted at pin 6 to AND gate U7A and compared with output 1 from U3A whereas U6B output is inputted at pin 9 to U3B and its output inputted to U7B. Accordingly, U6B at pins 12 and 13 must be high at the same time, along with U3B pins 9, 10, 11, and 12 to output U3 pin 13 to create a "dead ball" foul, and this result will occur at one-half the rate of "live ball" fouls.

Means 75 is provided to test the circuitry, clear and reset flip-flops U5A and U5B, and to insure that no LED indicator lights remain on after the test is over. This is accomplished by using resistor R1 and capacitors C1 to make the LED indicator lights blink and the whistle sound as soon as switch S1 is turned on and then reset to flip-flops 5A and 5B to their unlatched positions.

Figure 7:
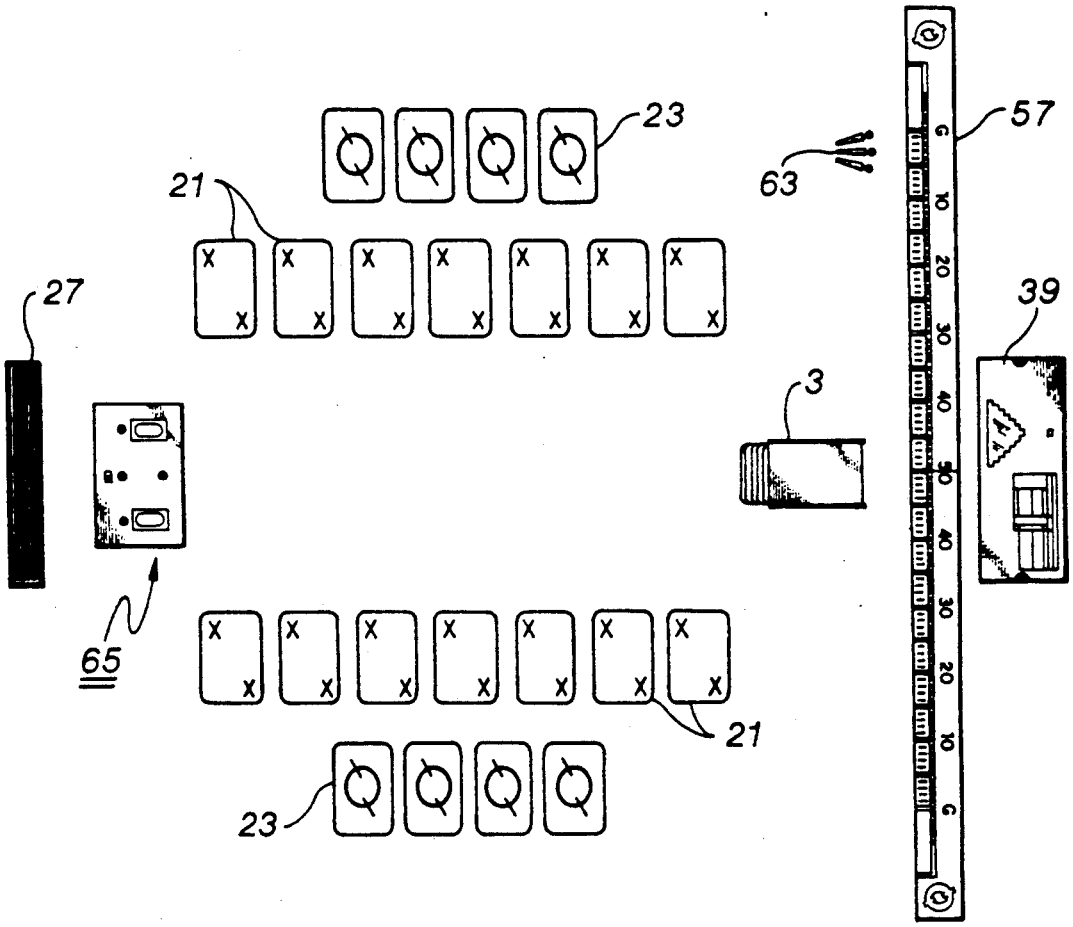
FIG. 7 is an illustrative view of how the cards are sometimes aligned by opposing sides and held by the players in the playing of the game.

To commence play and to achieve the initial line-up shown in FIG. 7, cards 1 are divided into two near-equal sub-decks, one of which is given to each of the players who then deals himself or herself 7 cards, face up, side-by-side, in a row in front of him or her, as shown at 21, whereupon each of these rows represents the offensive "line" or defensive "front" on a football team. Each of the players then deals himself or herself 4 more cards, face down, to be held in his or her hand, as shown at 23, whereupon each of these two sets of cards represents the offensive "backfield" or defensive "deep coverage" of a football team. The balance of cards 1 is thereafter placed in container 3 between, and to one side of, the rows and is known as the "draw-in pile". Foul indicator means 65 and chart device 39 are placed between, and to the other side of, the rows. Short strip segment 59A and 59B are arranged in one elongated strip 57 to stimulate the playing field, pegs 63 are placed near the holes and strip 57 is placed on the same side of the lines as container 3. The players determine, by chance, who will kick off. That player draws into his or her backfield, one more card and the game is started.

The player representing the offensive "team" plays one or more cards from its backfield to commence various plays such as running, kicking, and passing, in accordance with a set of rules provided with the game. The player representing the offensive "team" compares the values of the cards in its backfield to each other, to the cards on the offensive line and to the cards on the defensive line to determine whether the offense should run, pass, kick, etc. The cards dealt to each player determine in part his or her ability to make certain offensive and defensive maneuvers. Indicia on the cards also aids the defensive team to determine whether to attempt an interception, a dog, etc. Whenever the player representing the offensive "team" says "offensive set", the position of each member of the offensive team is set for the next play. Thereupon, the player representing the defensive "team" depresses "defense set" switch SW3, whereupon the portion of each member of the defensive team is also set for the next play. If electronic foul indicator means 65 emits a whistle at that time, a "dead ball" foul, such as encroachment, has occurred. At that time, the first drawing card 25 with indicia 35 is withdrawn from container 27 to determine the identity of the offending team, the foul committed and the penalty therefor and the other team may elect to enforce the penalty. Drawing card 25 is then replaced in container 27 at the opposite end of the stack of penalty cards.

If no "dead ball" foul has occurred as determined by foul indicator mean 65, play is commenced and then completed by one of the players depressing the "dead ball" foul switch SW2. If electronic foul indicator means 65 emits a whistle at that time, a "live ball" foul, such as clipping, has occurred during the play. Again, the first drawing card 25 with the indicia corresponding to the type of play completed is withdrawn from container 27 to determine the identity of the offending team, the kind of foul committed and the penalty therefor and the other team may elect to enforce the penalty.

The foregoing combination of possibilities greatly simulates the playing of the football game. The game continues and as each play exhausts cards from the teams, the players replace them with cards from the draw-in pile. Timer cards are inserted in the draw-in pile to indicate when 2 minutes in American football, or 3 minutes in Canadian football, remain in play in a half or the game.

Details of the functioning components of electronic foul indicator means 65 are as follows:

| COMPONENT DESCRIPTION | SOURCE | SOURCE NUMBER | QTY/ PER | REFERENCE |
|---|---|---|---|---|
| PCB, FOUL INDICATOR | TRILATRON | | 1 | |
| TWO INPUT AND GATE | MOTOROLA | MC4081B | 8 | U6A, U6B, U6A, U6B, U7A, U7B U7C, U7D |
| FOUR INPUT AND GATE | MOTOROLA | MC4082B | 2 | U3A, U3B |
| DARLINGTON TRNSTR ARRAY 16 PIN DIP, 500 MA, 30 V | MOTOROLA | ULN2004A | 7 | U10 |
| DUAL D FLIP-FLOP | NATIONAL | CD4013B | 2 | U5A, U5B |
| 7 STAGE BINARY COUNTER | NATIONAL | CD4024B | 1 | U2 |
| DUAL PRECISION TIMER | NATIONAL | LM555 | 4 | U1, 4, 8, 9 |
| RESISTOR, CARBON FILM, ¼ W, 5% | ANY | 10.0K | 5 | R2, 3, 11, 16, 17 |
| RESISTOR, CARBON FILM, ¼ W, 5% | ANY | 220.0 | 4 | R7, 9, 18, 19 |
| RESISTOR, CARBON FILM, ¼ W, 5% | ANY | 10.0M | 2 | R12, 13 |
| RESISTOR, CARBON FILM, ¼ W, 5% | ANY | 4.7K | 2 | R1, 20 |
| RESISTOR, CARBON FILM, ¼ W, 5% | ANY | 30.0K | 1 | R10 |
| RESISTOR, CARBON FILM, ¼ W, 5% | ANY | 39.0K | 1 | R14 |
| RESISTOR, CARBON FILM, ¼ W, 5% | ANY | 100.0K | 1 | R15 |
| RESISTOR, METAL FILM, ¼ W, 1% | ANY | 10.0K | 2 | R6, 8 |
| RESISTOR, METAL FILM, ¼ W, 1% | ANY | 100.0K | 1 | R4 |
| RESISTOR, METAL FILM, ¼W, 1% | ANY | 1.0M | 1 | R5 |

-continued

| COMPONENT DESCRIPTION | SOURCE | SOURCE NUMBER | QTY/ PER | REFERENCE |
|---|---|---|---|---|
| DIODE, SIGNAL, SWITCHING | MOTOROLA | 1N914 | 7 | CR1, 2, 5, 6, 7, 8, 12 |
| DIODE, ZENER, 3.9 V, 250 MW | MOTOROLA | 1N748 | 1 | CR11 |
| L.E.D. RED | ROME | SLH56-VR3 | 1 | CR10 |
| L.E.D. YELLOW | ROME | SLH56-YY3 | 1 | CR9 |
| L.E.D. GREEN | ROME | SLH56-MG3 | 2 | CR3, 4 |
| CAP, CRMC, RDL, 0.2 IN, 0.01 UF, 50 V +5.0%, AUTO INSERT | | | 2 | C11, 12 |
| CAP, CRMC, RDL, 0.2 IN, 0.1 UF, 50 V +20%, AUTO INSERT | SPRAGUE | | 8 | C1, 13, 15, 18, 19 21, 22, 23 |
| CAP, CRMC, RDL, 0.2 IN, 0.01 UF, 50 V +20%, AUTO INSERT | | | 6 | C4, 5, 10, 14, 17 20 |
| CAP, CRMC, RDL, 0.2 IN, 0.1 UF, 50 V +5.0% AUTO INSERT | | | 1 | C8 |
| BUSHING, BLK, LED | SPRAGUE-199D105X9035AE2 | | 2 | C2, 16 |
| CAP, TAN, RADIAL 0.2 IN, 1.0, 35 V | | | 2 | C2, 16 |
| SWITCH, PCB, 8MM | CHERRY | MX1A-11NW | 2 | SW2, 3 |
| 8 MM, BLK CAP | CHERRY | 0739-0397 | 2 | |
| SWITCH, PCB, SPST | C @ K | 1101-M2-C-B-E | 1 | SW1 |
| AUDIBLE ALARM, 2.8 KHz, 12 mA @ 9 V | MURATA | PBK5-3AO | 1 | SPK |
| BATTERY CABLE | KEYSTONE MOUSER | 12BC005 | 1 | |

What is claimed is:

1. A playing card-based simulated football game comprising:

a) a plurality of playing cards for at least two players, each of whom represents opposing football teams; said playing cards containing integers and play-controlling indicia for producing, under certain playing conditions, simulated football game plays including "draws", "traps", "bombs", "sacks" "dogs", and "live" ball situations;

b) a plurality of drawing cards housed in a container and retrieved by a player upon notification of the occurrence of a foul, said drawing cards showing the identity of the offending team, the type of foul which occurred and the penalty therefor, all virtually indistinguishable from those encountered in an actual football game;

c) a try-kick and field goal chart device comprising a hand-held container having a cover and a strip of flat material slidingly received therein, and having integers printed thereon, for matching with apertures in said cover to indicate a plurality of values of said playing cards that may be individually used to possibly insure success of a simulated kick, said values corresponding to the distance to a goal post of one of said opposing teams, d) an elongated strip having a series of apertures formed therein and uniformly spaced therealong to dimensionally simulate both the American football field of 100 yards, and the Canadian football field or 110 yards, and further including a plurality of small pegs for insertion into said apertures to mark the start of a drive, the line of scrimmage, and the line-to-gain; and, e) electronic foul indicator means, including a simulated official's whistle, for audibly notifying the players of the simulated occurrence of a foul, said occurrences arranged in random patterns and simulating the frequency of such fouls in an actual football game, said means controlled by the players during playing of the game.

2. The playing card-based simulated football game of claim 1 wherein said plurality of playing cards comprises a deck of 150 playing cards containing integers from 1 to 15 that is divided by the players into two, near-equal quantities and, from each quantity, each player deals 7 cards, side-by-side, face up, in front of him or her in a row, said rows representing the offensive "line" or defensive "front" of a football team, and 4 more cards, face down into his or her own hand, said cards representing the "backfield" or defensive "deep coverage" of a football team, with the balance of the cards for placement in one pile for later use.

3. The playing card-based simulated football game of claim 2 wherein said deck of 150 cards further includes 50 general purpose cards containing integers ranging from 1 to 15.

4. The playing card-based simulated football game of claim 2 wherein said deck of 150 cards further includes 45 cards containing integers ranging from 1 to 15, which, when used in an attempted pass, converts said attempted pass to a "bomb" pass, and allows the offense to obtain extra yardage on a completion and the defense to obtain extra yardage on an interception.

5. The playing card-based simulated football game of claim 2 wherein said deck of 150 playing cards further includes 30 cards containing integers ranging from 1 to 15, which, when one of these cards is used on a play, allows any one of a defensive "sack", a "quarterback" or "dog" tackle of a ball carrier behind the line of scrimmage.

6. The playing-card-based simulated football game of claim 2 wherein said deck of 150 playing cards further includes 15 cards containing integers ranging from 1 to 15, which, when one of these cards is used during recovery of a fumble, muff, or blocked kick, allows the recovering team to advance the ball.

7. The playing card-based simulated football game of claim 2 wherein said deck of 150 playing cards further includes 10 cards containing integers ranging from 2 to 5, which, if on the defensive line, allows the offense to obtain extra yardage on a running play by a "trap" or "draw" play.

8. The playing card-based simulated football game of claim 1 wherein said plurality of drawing cards further includes indicia for determining the identity of the team who has committed the foul, the type of foul committed and the penalty therefor, said foul occurring before the commencement of a play and thus being a "dead ball" foul or occurring during a play and thus being a "live ball" foul.

9. The playing card-based simulated football game of claim 8 wherein said indicia are all placed on one side of said cards and further contain tabs extending outward for withdrawing said cards from said container as a function of the type of play attempted previous to notification of the foul.

10. The playing card-based simulated football game of claim 1 wherein said try-kick and field goal chart device includes integers and matching apertures that indicate a variation in values of playing cards that may be used to obtain possible success of the kick as a function of the distance between the line of scrimmage and the goal post.

11. The playing card-based simulated football game of claim 1 wherein said elongated strip is made of solid sheet material separated into two shorter segments, said segments arranged to be joined at one end to form a full-length strip and containing indicia on one side thereof, and dividing the greater portions of said segments into 1-yard, 5-yard and 10-yard increments to form the 100-yard American football field.

12. The playing card-based simulated football game of claim 1 wherein said elongated strip is made of solid sheet material separated into two shorter segments, said segments arranged to be joined at one end to form a full-length strip and containing indicia on one side thereof, and dividing the greater portions of said segments into 1-yard, 5-yard and 10-yard increments to form the 110-yard Canadian football field.

13. The playing card-based simulated football game of claim 1 wherein said elongated strip contains indicia of 1, 5, and 10-yard increments simulating the 100-yard American football field on one side thereof, and contains indicia of 1, 5, and 10-yard increments simulating the 110-yard Canadian football field on the other side thereof.

14. The playing card-based simulated football game of claim 1 wherein said electronic foul indicator means includes a switch to control power thereto through, separate first and second activation switches, one of said switches for actuation by the player representing the defensive team setting the position of its members and another one of said switches for actuation by either player whenever any play is terminated, thus dividing the occurrence of fouls between two time periods, the first of which starts when the defense is set and ends when play is commenced and the second of which starts when play has commenced and ends when play is terminated.

15. The playing card-based simulated football game of claim 1 wherein said electronic foul indicator means includes a precision timer powered by a battery and arranged to output a series of electronic pulses in separate trains each of which is a division of the previous pulse train and further arranged to activate an electronic speaker to provide audible indication of the occurrence of a foul.

16. The playing card-based simulated football game of claim 15 wherein said electronic foul indicator means further includes a precision timer activated by the same electronic pulse that activates said electronic speaker to provide power to illuminate visual foul indicator means for a period of time following the termination of the audible foul signal.

17. The playing card-based simulated football game of claim 15 wherein said electronic foul indicator means further includes means to initiate a warning when said battery powering said means runs low and comprises a 2-input AND gate whose output is inverted and joined with the electronic pulses to energize a visual indicator light to blink slowly when the voltage in said battery drops below a chosen value.

18. The playing card-based simulated football game of claim 15 wherein said electronic foul indicator means further includes means to reduce the electrical load on said battery during play and comprises a separate precision timer arranged to provide a high frequency pulse rate that is inputted to visual indicator lamps through flip-flop switches so that, during play, the respective visual indicator lamp will be lit through said high frequency to the extent it will show visible light, yet reduce the load on said battery that would have been encountered if said lamp were lit with a constant current.

19. The playing card-based simulated football game of claim 15 wherein said electronic foul indicator means further includes means to test the circuitry, clear all switches and insure that no visual indicator lights remain lit after the test is over.

* * * * *